US009386805B2

(12) United States Patent
Liu

(10) Patent No.: US 9,386,805 B2
(45) Date of Patent: Jul. 12, 2016

(54) ELECTRONIC CIGARETTE

(75) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 651 days.

(21) Appl. No.: 13/824,440

(22) PCT Filed: Jul. 9, 2012

(86) PCT No.: PCT/CN2012/078360
§ 371 (c)(1),
(2), (4) Date: Mar. 18, 2013

(87) PCT Pub. No.: WO2014/008623
PCT Pub. Date: Jan. 16, 2014

(65) Prior Publication Data

US 2014/0007891 A1 Jan. 9, 2014

(51) Int. Cl.
*A24F 47/00* (2006.01)

(52) U.S. Cl.
CPC ..... *A24F 47/008* (2013.01); *A24F 47/002* (2013.01)

(58) Field of Classification Search
CPC ..... A24F 47/002–47/008
USPC ..... 131/194, 270–273; 128/202.21
See application file for complete search history.

(56) References Cited

U.S. PATENT DOCUMENTS

2011/0011396 A1* 1/2011 Fang ..... A61M 15/06 128/202.21
2011/0089892 A1* 4/2011 Lin ..... H01M 2/1055 320/107

(Continued)

FOREIGN PATENT DOCUMENTS

CN 200997909 * 2/2008 ..... A24D 1/18
CN 201408820 * 2/2010 ..... A24B 15/00
CN 201733855 * 9/2010 ..... A24F 47/00

(Continued)

OTHER PUBLICATIONS

CN200997909 (Machine Translation) [online], [retrieved on Oct. 30, 2015], retrieved from ESPACENET (http://worldwide.espacenet.com/?locale=en_EP).*
CN 201408820 (Machine Translation) [online], [retrieved on Oct. 30, 2015], retrieved from ESPACENET (http://worldwide.espacenet.com/?locale=en_EP).*

(Continued)

*Primary Examiner* — Michael H Wilson
*Assistant Examiner* — Yana B Krinker
(74) *Attorney, Agent, or Firm* — Cheng-Ju Chiang

(57) ABSTRACT

The invention is related to an electronic cigarette which is equipped with a universal serial bus (USB) connector. The electronic cigarette includes a cigarette body and a connecting device. The connecting device is retractably disposed in the cigarette body so as to be hidden therein, and the connecting device includes a connector and a conductor of which a length is extendable. When not in use, the conductor is foldably retracted to be hidden within the cigarette body together with the connector, while the connecting device is in use, the connecting device is pulled away and the conductor extends to a predetermined length to electrically connect the electronic cigarette to an external electronic device or power. Because the USB connector and the conductor are disposed in the electronic cigarette, the electronic cigarette is capable of being used conveniently and assembled quickly.

12 Claims, 11 Drawing Sheets

(56) References Cited

U.S. PATENT DOCUMENTS

| | | | | | |
|---|---|---|---|---|---|
| 2011/0303231 | A1* | 12/2011 | Li | ..... | A24F 47/008 131/329 |
| 2011/0304282 | A1* | 12/2011 | Li | ..... | A24F 47/008 315/362 |

FOREIGN PATENT DOCUMENTS

| | | | | | |
|---|---|---|---|---|---|
| CN | 202112305 | * | 1/2012 | ..... | A24F 47/00 |
| KR | 20120057459 | * | 6/2012 | ..... | A24F 47/00 |

OTHER PUBLICATIONS

CN201733855 (Machine Translation) [online], [retrieved on Oct. 30, 2015], retrieved from ESPACENET (http://worldwide.espacenet.com/?locale=en_EP).*

CN202112305 (Machine Translation) [online], [retrieved on Oct. 30, 2015], retrieved from ESPACENET (http://worldwide.espacenet.com/?locale=en_EP).*

KR20120057459 (Machine Translation) [online], [retrieved on Oct. 30, 2015], retrieved from ESPACENET (http://worldwide.espacenet.com/?locale=en_EP).*

* cited by examiner

ELECTRONIC CIGARETTE

CROSS REFERENCE TO RELATED APPLICATIONS

The present application is a 35 U.S.C. §371 National Phase conversion of International (PCT) Patent Application No. PCT/CN2012/078360, filed on Jul. 9, 2012, the disclosure of which is incorporated by reference herein. The PCT International Patent Application was filed in Chinese.

BACKGROUND OF THE INVENTION

1. Field of the Invention

The present invention relates to an electronic cigarette, and particularly to an electronic cigarette internally equipped with a universal serial bus (USB) connector.

2. Related Art

A conventional electronic cigarette includes a cigarette rod in which a control circuit unit is installed, and a universal serial bus (USB) connector is disposed on an outside portion of the cigarette rod and connected to the control circuit unit through a conductor. The conventional cigarette rod generally has an inhaling rod and a battery rod, wherein the inhaling rod and the battery rod are screwingly connected.

The conventional electronic cigarette has drawbacks as follows: first, it is inconvenient to use and slightly, because the USB connector is disposed at the outside portion of the cigarette rod; second, it is inconvenient and time consuming to disassemble the inhaling rod with the battery rod by screw thread.

SUMMARY OF THE INVENTION

An object of the present invention is to provide an electronic cigarette having a USB connector and a conductor both disposed in the electronic cigarette, whereby providing a convenient use, easy and quick assembly, and an aesthetic appearance.

To achieve the above object, an electronic cigarette of the present invention, comprises: a cigarette body and a connecting device. The connecting device is retractably disposed in the cigarette body so as to be hidden therein, and comprises a connector and a conductor of which a length is extendable, the conductor capable of being retractably received in the cigarette body, one end of the conductor connected to the connector, the other end of the conductor electrically connected to a circuit control unit disposed in the cigarette body. The connector is capable of being retractably disposed in the cigarette body and extends out of the cigarette body through the retractable conductor to a pre-determined distance. When the connecting device is not in use, the conductor is foldably retracted to be hidden within the cigarette body together with the connector, while the connecting device is in use, the connecting device is pulled away and the conductor extends to a predetermined length, whereby the connector electrically connects the electronic cigarette to an external electronic device or power.

According to another embodiment of the present invention, the connecting device further comprises a support base disposed in the cigarette body for accommodating and positioning the connector, a first accommodating chamber is defined in the support base for accommodating the connector and the conductor, the first accommodating chamber having a wall body defining a cylindrical front portion for allowing the connector and the conductor to extend out of or retract to the support base, and the cylindrical front portion corresponds to an inner wall of the cigarette body.

According to another embodiment of the present invention, the conductor comprises a movable conductor and a fixing conductor both integrally connected with each other over a coupling element disposed in between the movable conductor and the fixing conductor, the coupling element is mounted to the support base, one end portion of the movable conductor is electrically connected to one end portion of the fixing conductor through the coupling element, the conductor is electrically connected to the connector through the one end portion of the movable conductor, and the conductor is electrically connected to a control circuit unit in the electronic cigarette through another end portion of the fixing conductor.

According to another embodiment of the present invention, the support base is formed with at least one conductor positioning element for mounting the coupling element, and the coupling element is formed with at least one mounting hole for being mounted to the at least one conductor positioning element, the cylindrical front portion of the support base has a positioning stage radially formed on an outer wall thereof for matching with the cigarette body, the support base is mounted into the cigarette body, and the outer wall of the cylindrical front portion is snugly mounted to the inner wall of the cigarette body and positioned by the positioning stage.

According to another embodiment of the present invention, the connector is a universal serial bus (USB) connector, a peg-type or a pin-type connector, the connector is substantially cylindrical and defined with the first accommodating chamber and a through hole therein, the outer wall of the support base is formed with a conductor slit, and the conductor passes through the through hole from the first accommodating chamber along the conductor slit to electrically connect the control circuit unit.

According to another embodiment of the present invention, the cigarette body has an inhaling rod and a battery rod, the inhaling rod comprises an inhaling cylinder, an inhaling nozzle, an atomizer disposed in the inhaling cylinder, and a cigarette liquid storing cup for storing a cigarette liquid, the battery rod comprises a barrel, a battery installed in the barrel, and a bottom case mounted to a bottom of the barrel, the connecting device is disposed in the barrel, and the bottom case covers the bottom of the barrel so as to seal the connecting device in the end of the barrel.

According to another embodiment of the present invention, the cigarette liquid storing cup comprises a cup seat and a cup lid both are spaced apart from each other at a predetermined space and are snugly mounted onto inner walls of the inhaling cylinder, a guiding tube and a liquid storing element both are disposed in between the cup seat and the cup lid, the guiding tube is being internally hollow with two opposite ends thereof open to outside, and the atomizer is fixedly held by the guiding tube, a positioning tube is mounted onto outer walls of the guiding tube for preventing the atomizer from moving in an axial direction of the guiding tube, the positioning tube and the guiding tube are in interference fit with each other, and the positioning tube abuts against the atomizer.

According to another embodiment of the present invention, the cup seat has a cylindrical cup structure, a positioning pillar formed in the cup seat for positioning the guiding tube, and a round internal chamber for receiving the liquid storing element; the cup lid having a substantially cylindrical lid structure, a circular internal cavity formed in the cup lid for receiving the guiding tube, a plurality of air vents formed on a side wall of the he cup lid, a plurality of ribs formed on an upper wall of the cup lid in the circular internal cavity, each of the plurality of ribs having a width smaller than an inner diameter of the guiding tube, a bottom of the cup lid extending radially outward to form a flange portion, wherein the flange portion is serrated and has multiple serrations, the serrations having gaps formed therebetween for enabling flow of the cigarette liquid to the cigarette liquid storing cup, two opposite ends of the guiding tube are respectively positioned by the upper wall of the cup lid and the positioning pillar of the cup seat, and the flange portion is disposed with respect to the round internal chamber of the cup seat for positioning two opposite ends of the liquid storing element.

According to another embodiment of the present invention, the inhaling rod and the battery rod are respectively installed with a male connecting element and a female connector so as to enable the inhaling rod and the battery rod to be plugged with each other, and the male and female connecting elements respectively have atomizer electrode elements and battery electrode elements, whereby the atomizer electrode element and the battery electrode element are in flexibly contact with each other to realize electrical connection.

According to another embodiment of the present invention, the male connecting element is substantially shaped as a round cover being internally hollow and has multiple air inlets radially formed at a bottom of the male connecting element, and a positioning step is formed by extending outward radially from the bottom of the male connecting element for abutting against a bottom of the inhaling cylinder, an first accommodating chamber is formed on the bottom of the male connecting element for being snugly mounted onto the battery rod, electrode slots are formed on a middle portion of the male connecting element and penetrate the male connecting element in an axial direction thereof, and a positioning projection is radially formed on the bottom of the male connecting element and extends outward in the axial direction.

According to another embodiment of the present invention, the female connecting element is substantially shaped as a round cover and has a side wall, an upper wall, an internal chamber defined by the side wall and the upper wall, a locating step is formed on the side wall adjacent to the upper wall and extends outward radially from the female connecting element for fitting to the battery rod, an inserting peg is disposed on the upper wall and extends outward in an axial direction of the female connecting element for being inserted into the first accommodating chamber of the male connecting element, the upper wall is concavely formed with a plurality of positioning grooves for positioning the positioning projection of the male connecting element, threading holes are formed in and penetrate the female connecting element in the axial direction, two electrode slits extend in the axial direction for positioning the battery electrode elements, and two internal channels for the insertion of the atomizer electrode elements with which the battery electrode elements re in flexible contact in the internal channels.

According to another embodiment of the present invention, the atomizer comprises at least one heating element, the atomizer electrode elements includes an atomizer first electrode element and an atomizer second electrode element respectively electrically connect with positive and negative electrodes of the at least one heating element, the battery electrode elements includes a battery first electrode element and a battery second electrode element respectively electrically connect with positive and negative electrodes of the battery, and the atomizer first and second electrode elements and the battery first and second electrode elements are all made of flexible metal conductive sheets.

According to another embodiment of the present invention, the atomizer first electrode element is a metal conductive sheet being flexibly deformable and is formed with a soldering plate of a soldering hole at one end thereof, a flexible contact plate being flexibly deformable and formed at another end of the atomizer first electrode element, and an engaging plate being flexibly deformable and formed at a middle of the atomizer first electrode element for engaging with the male connecting element; and the atomizer second electrode element has a structure same as that of the atomizer first electrode element.

According to another embodiment of the present invention, the battery first electrode element is a metal conductive sheet being flexibly deformable and is formed with a soldering plate of a soldering hole at one end thereof, a flexible contact plate being flexibly deformable and formed at another end of the battery fist electrode element, and an engaging plate being flexibly deformable and formed at a middle of the battery fist electrode element for engaging with the female connecting element; and the battery second electrode element has a structure same as that of the battery first electrode element.

According to another embodiment of the present invention, the atomizer first and second electrode elements and the battery first and second electrode elements each is formed with a soldering plate having a soldering hole at one end thereof, a flexible contact plate being flexibly deformable and formed at another end thereof, and an engaging plate being flexibly deformable and formed at a middle for engaging with corresponding male or female connecting element, the atomizer first and second electrode elements respectively electrically connect the negative electrodes of the at least one heating element through the soldering plates and soldering holes, the battery first and second electrode elements respectively electrically connect the positive and negative electrodes of the battery through the soldering plates and soldering holes, and the atomizer first and second electrode elements are in flexible contact with the battery first and second electrode elements through the flexible contact plates thereof to realize electrical connection.

Accordingly, the present invention has the advantages as follows: first, because the USB connector and the conductor are disposed in the electronic cigarette, the electronic cigarette is convenient to use and is aesthetic.

Secondly, the support base defines a first accommodating chamber formed therein for accommodating the USB connector and the conductor, whereby the USB connector and the conductor are freely to move therein.

Thirdly, the inhaling rod and the battery rod are pluggable to each other and therefore such way enables a convenient and quick assembly or disassembly.

Fourthly, the positive and negative electrodes of the atomizer electrically connect the positive and negative electrodes of the battery in a manner that the atomizer first and second electrode elements are in flexibly contact with the battery first and second electrode elements, whereby the technical craft is being simplified, assembly is easy to be done, and electrical connection is reliable.

Fifthly, structure of the cup lid of the cigarette liquid storing cup is configured to efficiently discharge smoke and to enable a quickly flow of a cigarette liquid to the cigarette liquid storing cup.

Finally, a positioning tube is mounted onto outer walls of the guiding tube so as to further position and hold the atomizer in the guiding tube Detailed description of the present invention is given below in conjunction with appendix drawings.

DESCRIPTION OF THE PREFERRED EMBODIMENTS

Figure 1:
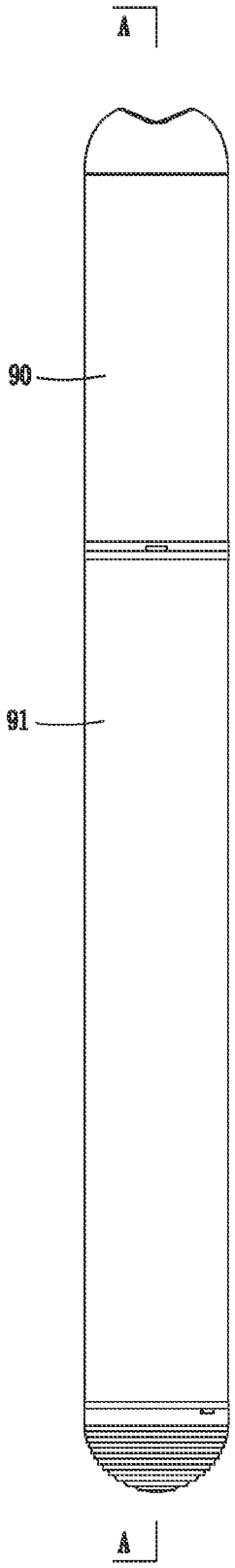
FIG. 1 is a front elevational view of an electronic cigarette of the present invention.

As shown in FIGS. 1 to 23, a first embodiment of the present invention is to provide an electronic cigarette, comprising a cigarette body having an inhaling rod 90 and a battery rod 91. The cigarette body is installed with a retractable connecting device 7. The connecting device 7 is retractably disposed in the cigarette body so as to be hidden therein. When not in use, the connecting device 7 is foldably retracted to be completely hidden within the cigarette body together. When in use, the connecting device 7 is being pulled away to extend to a predetermined length, whereby electrically connecting the electronic cigarette to an external electronic device or power. The connecting device 7 is intended to charge the electronic cigarette and to transmit data as well, such as multimedia data, so as to satisfy requirements of multi functions of the electronic cigarette. The connecting device 7 at least comprises a connector 71 and a conductor 72 of which a length is extendable. The connector 71 is one of a universal serial bus (USB) connector, a peg-type, a pin-type or other appropriate connector. A preferable embodiment described below is exemplified by the USB connector 71 in order to achieve the object of charging the electronic cigarette.

Figure 2:
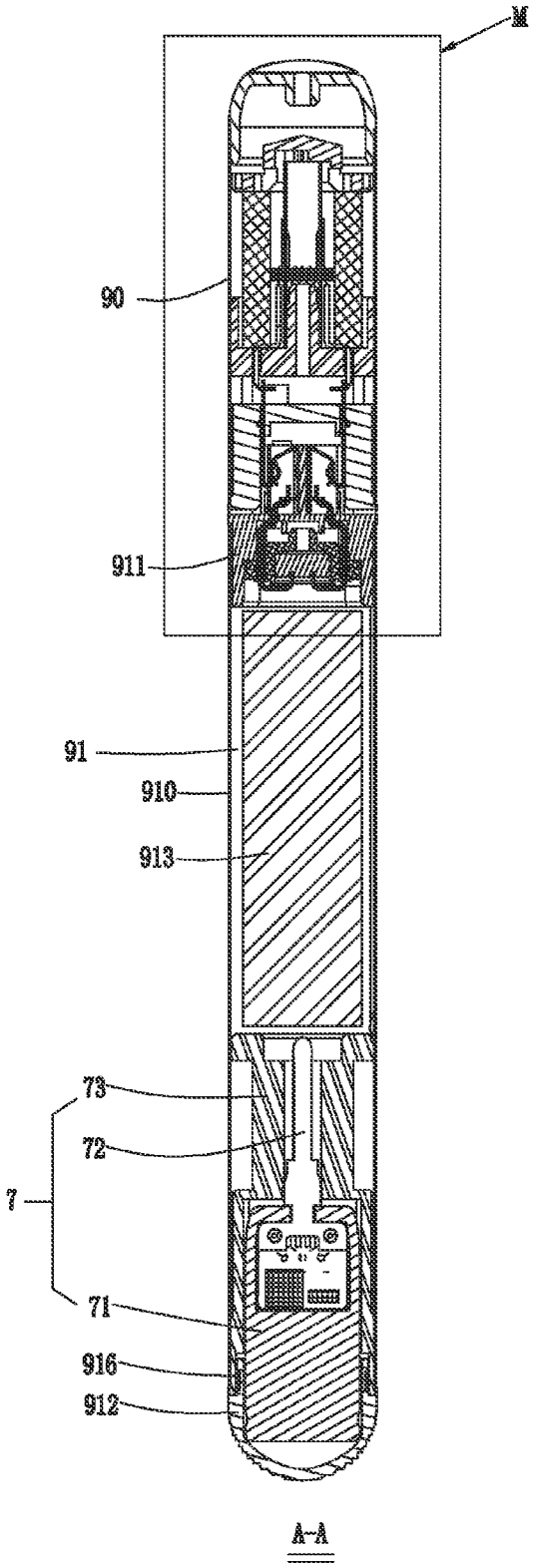
FIG. 2 is a cross-sectional view taken along line A-A in FIG. 1.
Figure 3:
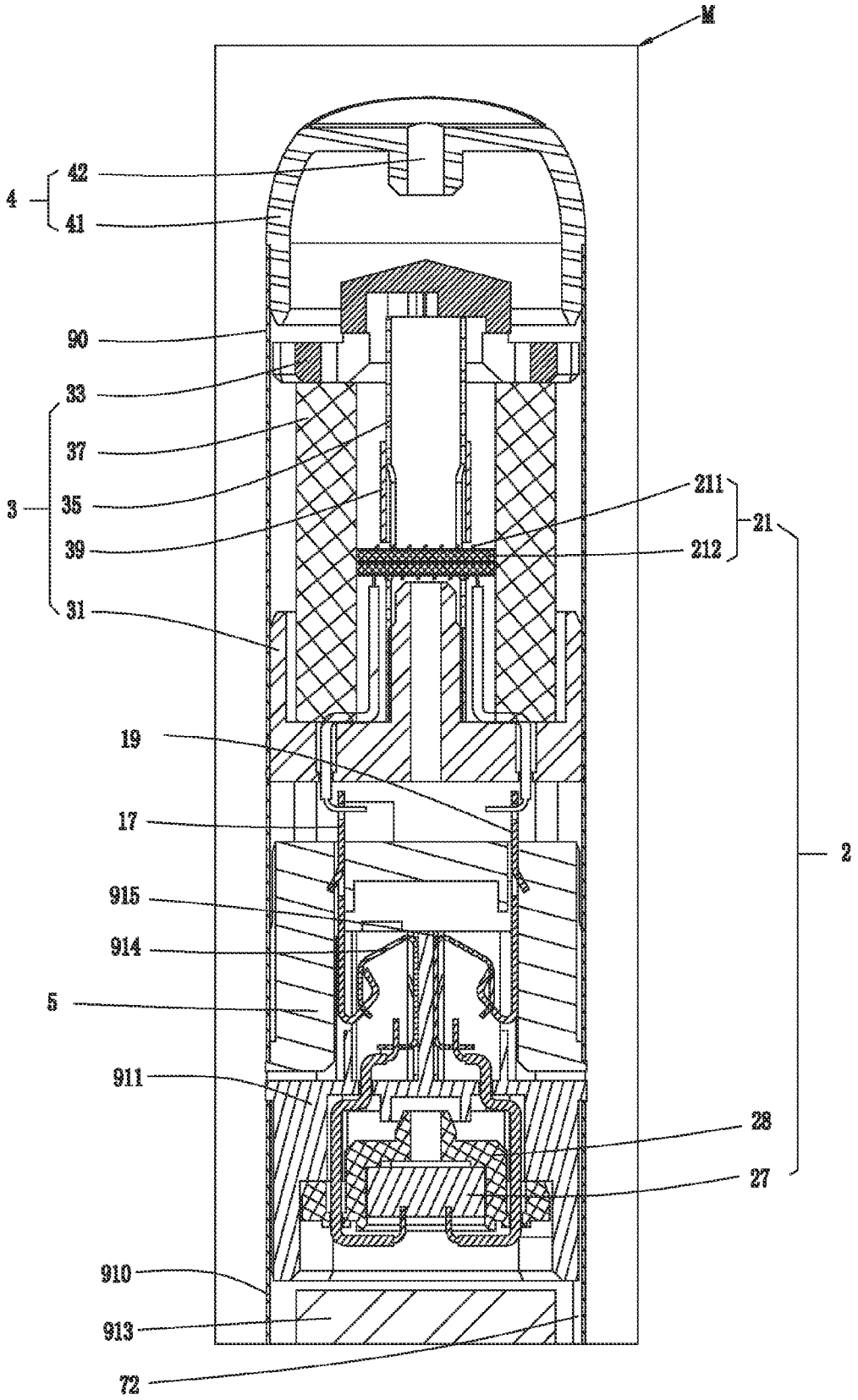
FIG. 3 is an enlarged view of an M portion indicated in FIG. 2.
Figure 4:
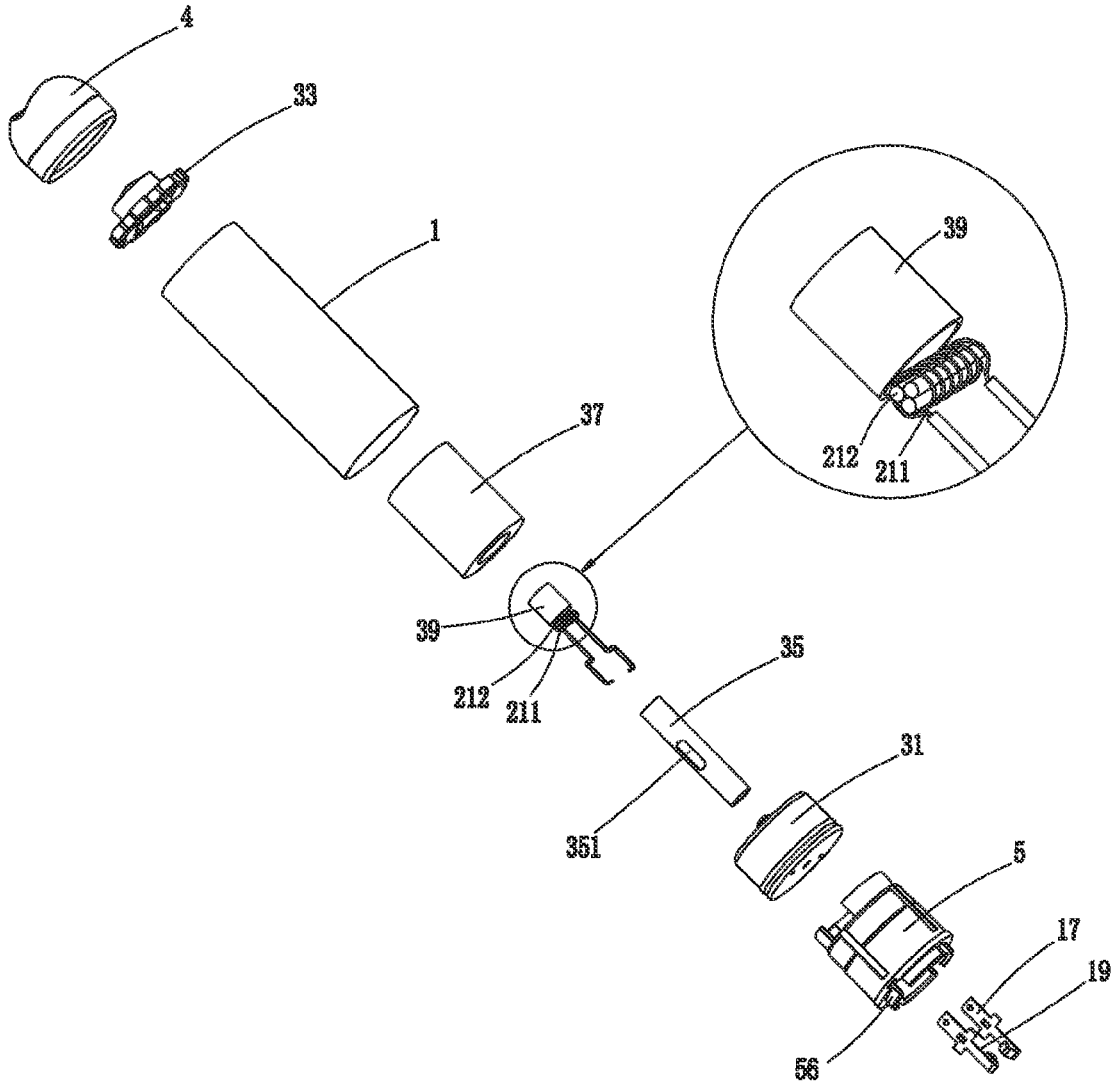
FIG. 4 is an exploded view of an inhaling rod of the electronic cigarette of the present invention.

As shown in FIGS. 2 to 4, the inhaling rod 90 comprises an inhaling cylinder 1, an atomizing device 2 for atomizing a cigarette liquid, a cigarette liquid storing cup 3 for storing the cigarette liquid, an inhaling nozzle 4, and a male connecting element 5 for connecting the battery rod 91. In this embodiment, the inhaling cylinder 1 is a hollow elongated tube structure, and the inhaling nozzle 4 and the male connecting element 5 are mounted to opposite end portions of the inhaling cylinder 1.

As shown in FIG. 3, the inhaling nozzle 4 has a substantially cylindrical body 41, which is internally hollow and has an inhaling hole 42 penetrating the cylindrical body 41 in an axial direction thereof. The inhaling nozzle 4 is made of a resilient material, and is detachably plugged into a top end of the inhaling cylinder 1.

As shown in FIGS. 3, 4, 9 and 10, the male connecting element 5, made of a flexible material, is disposed at a bottom of the inhaling cylinder 1 and has a shape fitted to the inhaling cylinder 1. The male connecting element 5 is substantially shaped as a round cover being internally hollow, and has multiple air inlets 51 formed at a bottom thereof along peripheral rims of the male connecting element 5 for allowing the outside air to flow in the inhaling cylinder 1. A positioning step 52 is formed by extending outward radially from the bottom of the male connecting element 5 for abutting against the bottom of the inhaling cylinder 1. A first accommodating chamber 53 is formed on the bottom of the male connecting element 5 for being snugly mounted onto the battery rod 91. Electrode slots 54 and air vents 55 are respectively formed on a middle portion of the male connecting element 5 and penetrate the male connecting element 5 in an axial direction thereof. A positioning projection 56 is formed on the bottom of the male connecting element 5 and extends outward in the axial direction for being inserted into the battery rod 91.

Figure 13:
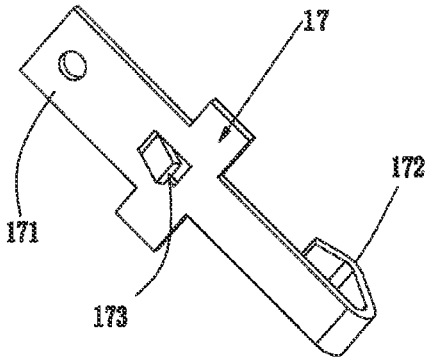
FIG. 13 is a perspective view of an atomizer first electrode element of the inhaling rod of the present invention.

As shown in FIGS. 3, 4 and 13, the inhaling cylinder 1 further comprises an atomizer first electrode element 17 and an atomizer second electrode element 19 for electrically connecting electrodes of the battery rod 91. Both of the atomizer first and second electrode elements 17 and 19 are disposed in the male connecting element 5. The atomizer first electrode element 17 is a flexibly deformable metal sheet and has a soldering plate 171 at one end thereof, the soldering plate 171 defining a soldering hole, a flexible contact plate 172 being flexibly deformable and formed at another end thereof, and an engaging plate 173 being flexibly deformable and formed at a middle of the atomizer first electrode element 17 for engaging with the male connecting element 5. The atomizer second electrode element 19 has a structure same as that of the atomizer first electrode element 17.

Figure 5:
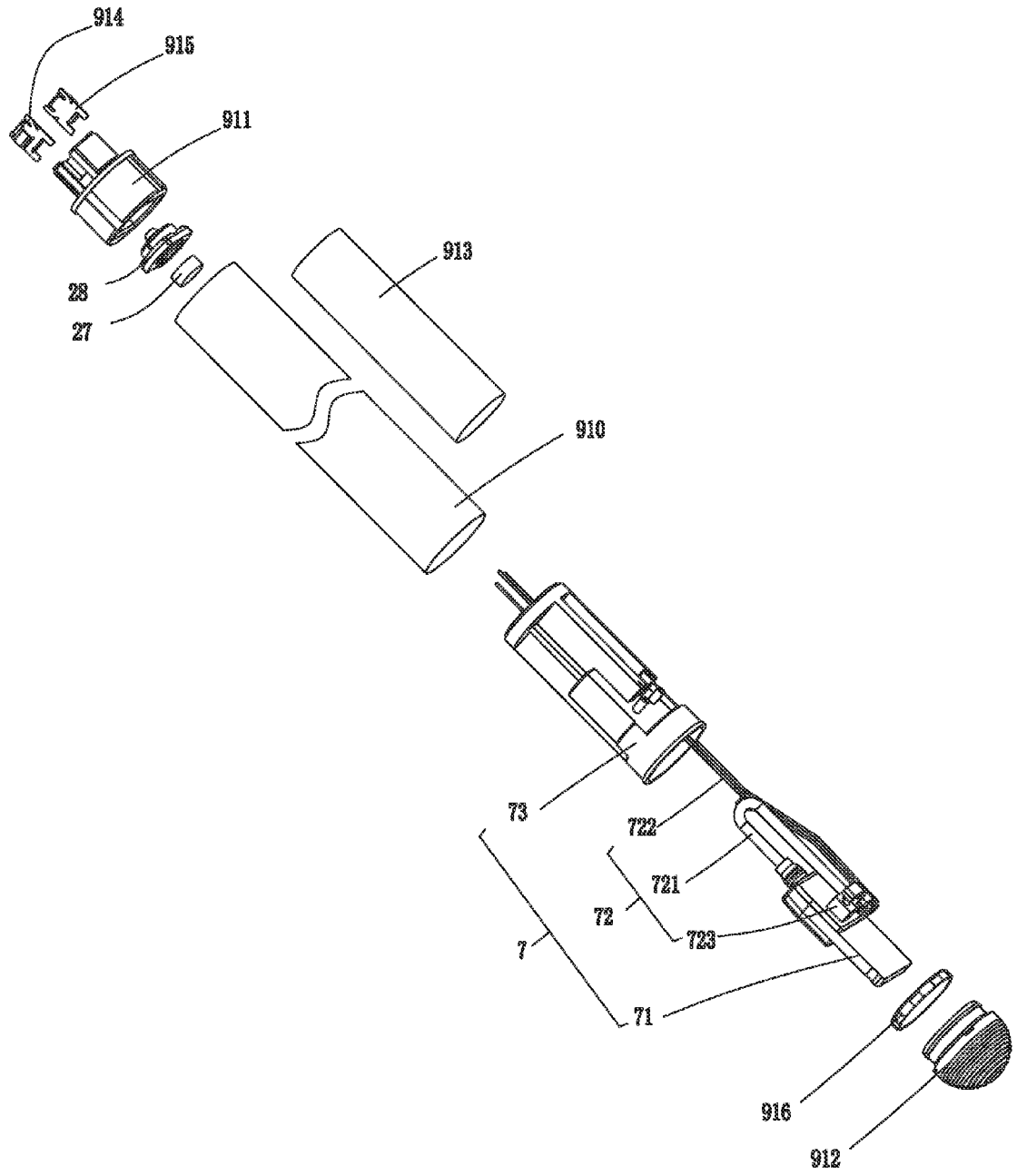
FIG. 5 is an exploded view of a battery rod of the electronic cigarette of the present invention.
Figure 6:
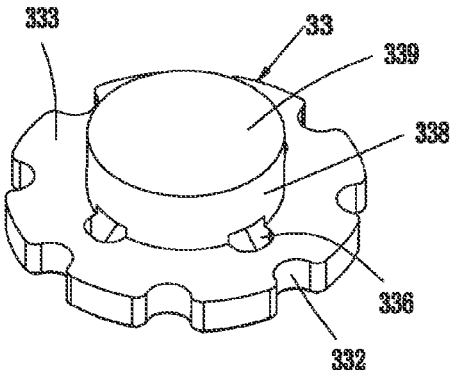
FIG. 6 is a first perspective view of a cup lid of a cigarette liquid storing cup of the inhaling rod of the present invention.
Figure 7:
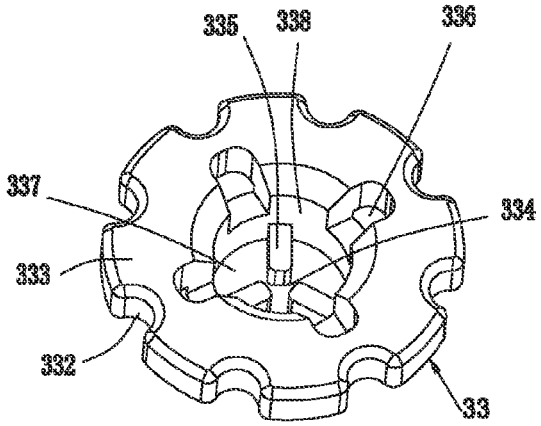
FIG. 7 is a second perspective view of the cup lid of the cigarette liquid storing cup of the inhaling rod of the present invention.
Figure 8:
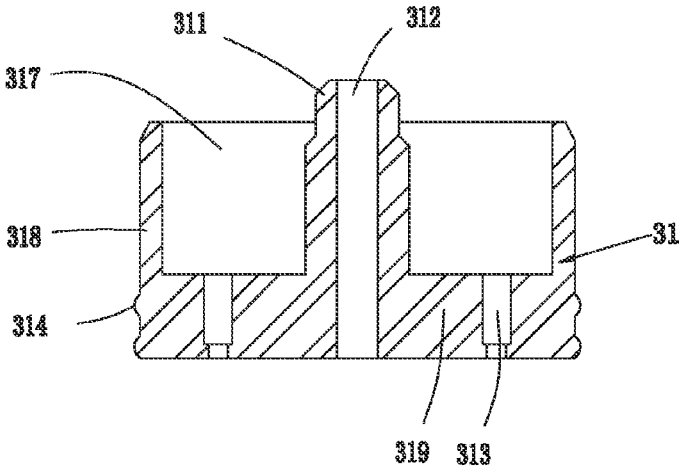
FIG. 8 is a cross-sectional view of a cup seat of the cigarette liquid storing cup of the inhaling rod of the present invention.
Figure 9:
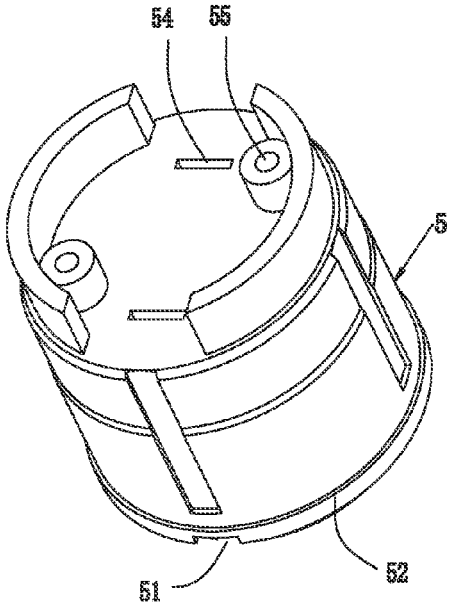
FIG. 9 is a perspective view of a male connecting element of the inhaling rod of the present invention.
Figure 10:
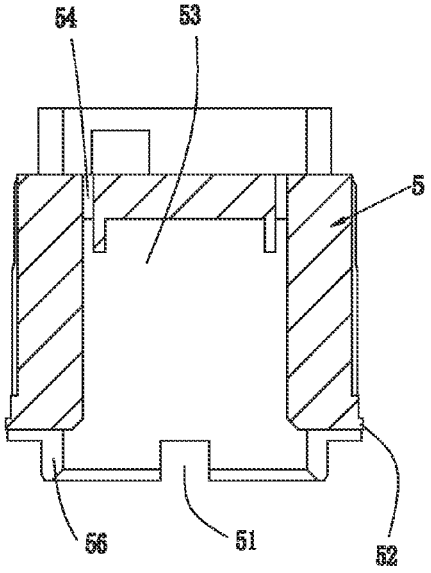
FIG. 10 is a cross-sectional view of the male connecting element of the inhaling rod of the present invention.

As shown in FIGS. 3 to 5, the atomizing device 2 comprises an atomizer 21 installed in the inhaling rod 90, an atomizer switch 27, a switch base 28, and a control circuit unit for controlling the atomizer 21.

The atomizer 21 is intended to atomize the cigarette liquid to be smoke, and comprises a heating element 211 and fiber elements 212. The heating element 211 is wound around the fiber elements 212 and held in a cigarette liquid storing cup 3. The fiber elements 212 are intended to absorb the cigarette liquid for the heating element 211 to heat and atomize. The fiber elements 212 function as a sponge that is capable of absorbing and preserving water, and are made of glass fiber or a material having characters of absorbing and isolating liquid, such as cotton, and have a tubular shape. In this embodiment, the number of the fiber elements 212 is three (not limited thereby). The three fiber elements 212 as a whole are disposed in the cigarette liquid storing cup 3. The heating element 211 is wound around outer surfaces of the whole three fiber element 212, wherein two opposite ends of the heating element 211 respectively extend out of the cigarette liquid storing cup 3 for electrically connecting with the atomizer first electrode element 17 and the atomizer second electrode element 19 of the male connecting element 5.

As shown in FIGS. 3 and 4, the cigarette liquid storing cup 3 comprises a cup seat 31, a cup lid 33, a guiding tube 35, a liquid storing element 37, and a positioning tube 39. The cup seat 31 and cup lid 33 both are spaced apart from each other at a predetermined space and are in snug-fit engagement with inner walls of the inhaling cylinder 1. The guiding tube 35 is mounted between the cup seat 31 and the cup lid 33. The liquid storing element 37 is disposed outside the guiding tube 35 between the cup seat 31 and the cup lid 33. The positioning tube 39 is intended to position the atomizer 21.

In this embodiment, the cup seat 31 (referring to FIGS. 3, 4 and 8) has a cylindrical cup structure, a round side wall 318, a round cup bottom 319, a positioning pillar 311 extends in an axial direction of cup seat 31 from a middle of the cup bottom 319, wherein the round side wall 318 and the positioning pillar 311 cooperatively define a round internal chamber 317. An air channel 312 is formed in the positioning pillar 311 and penetrates the positioning pillar 311 and the bottom cup 319 in its axial direction. A plurality of threading channels 313 are formed on and penetrate the cup bottom 319 for the heating element 211 to pass through. An outer surface of the side wall 318 is formed with a jam-fit ring 314. The cup seat 31 is snugly fitted to an inner wall of the inhaling cylinder 1 with the side wall 318 and the jam-fit ring 314.

The cup lid 33 (referring to FIGS. 3, 4, 6 and 7) is made of silica gel, and has a shape and size corresponding to the inner wall of the inhaling cylinder 1. In this embodiment, the cup lid 33 is a hollow cylindrical lid structure, and has a side wall 338 and an upper wall 339 both cooperatively define a circular internal cavity 337 having an inner diameter greater than an outer diameter of the guiding tube 35 in order for flow of smoke. A plurality of air vents 336 are formed on a side wall of the cup lid 33 and communicate with the circular internal cavity 337. A plurality of ribs 335 are formed on the upper wall 339 and located in the circular internal cavity 337. In this embodiment, there are three ribs 335 radially disposed on a middle portion of the upper wall 339, whereby when the guiding tube 35 is engaged with the ribs 224, a top end of the guiding tube 35 and the upper wall 339 jointly form a gap as a venting path 334 communicating with the circular internal cavity 337. A bottom of the side wall 338 extends radially outward to form a flange portion 333 which has multiple arc cutouts 332 and thus render the flange portion 333 serrated. An outer diameter of the flange portion 333 is slightly greater than an inner diameter of the inhaling cylinder 1. The cup lid 33 is snugly fitted with the inner wall of the inhaling cylinder 1 through the flange portion 333. The circular internal cavity 337 of the cup lid 33 corresponds to the positioning pillar 311 of the cup seat 31 and both respectively position the opposite ends of the guiding tube 35. The flange portion 333 of the cup lid 33 and the round internal chamber 317 of the cup seat 31 respectively fix two opposite ends of the liquid storing element 37. When the cigarette liquid is running out, pull out the inhaling nozzle 4 and remain the cup lid 33, and the cigarette liquid can be refilled in the cigarette liquid storing cup 3 from the arc cutouts 332 of the cup lid 33. The cigarette liquid is absorbed by the liquid storing element 37 and is capable of being repeatedly refilled in a convenient way.

The guiding tube 35 (referring to FIGS. 3 and 4) is intended to support the liquid storing element 37 and the fiber elements 212 and limit the height of the cigarette liquid storing cup 3, and further functions as a path to outside of the inhaling cylinder 1 for the flow of smoke produced by the atomizer 21 atomizing the cigarette liquid. In this embodiment, the guiding tube 35 is an insulating hollow cylinder, made of a plastic or fiber material, such as a fiberglass sleeve. The guiding tube 35 has top and bottom ends, wherein the top end is mounted in the circular internal cavity 337 of the cup lid 33, and the bottom end is snugly mounted to the positioning pillar 311 of the cup seat 31. The guiding tube 35 is formed with a retaining slot 351 penetrating side walls of the guiding tube 35 in a radial direction for retaining the fiber elements 212. The fiber elements 212 are fixed in the retaining slot 351 with two ends of the fiber elements 212 abutting against the liquid storing element 37 so as to absorb the cigarette liquid for the heating element 211 to atomize.

The liquid storing element 37 (referring to FIGS. 3 and 4) is intended to absorb and store the cigarette liquid in the cigarette liquid storing cup 3 so as to allow the atomizer 21 to atomize the cigarette liquid. The liquid storing element 37 functions as a sponge that is capable of absorbing and preserving water, and is made of glass fiber or a material having characters of absorbing and isolating liquid, such as cotton. The liquid storing element 37 is a hollow cylindrical structure and is disposed outside the guiding tube 35. One end of the liquid storing element 37 is inserted in the round internal chamber 317 of the cup seat 31 and the other end abuts against the bottom of the cup lid 33 such as the liquid storing element 37 is disposed between the cup seat 31 and the cup lid 33. Two ends of the fiber elements 212 abut against inner walls of the liquid storing element 37 to absorb the cigarette liquid for the heating element 211 to atomize.

The positioning tube 39 (referring to FIGS. 3 and 4) is intended to locate a position of the atomizer 21 with respect to the guiding tube 354. The positioning tube 39 is an insulating hollow cylinder being mountable onto outer walls of the guiding tube 35, and is made of a plastic or fiber material, such as a fiberglass sleeve. The positioning tube 39 and the guiding tube 35 are in interference fit with each other. A bottom of the positioning tube 39 abuts against the atomizer 21 to prevent the atomizer 21 from moving in an axial direction of the guiding tube 35.

In this embodiment, the cigarette liquid storing cup 3 defines a smoke path therein that is formed by the air channel 312 of the cup seat 31, a hollow passageway of the guiding tube 35, the venting path 334 of the cup lid 33, the circular internal cavity 337 and air vents 336 all together.

As shown in FIGS. 2, 3 and 5, the battery rod 91 comprises a barrel 910, a female connecting element 911 and a bottom case 912 respectively mounted to opposite ends of the barrel 910, a battery 913 installed in the barrel 910, and a battery first electrode element 914 and a battery second electrode 915 electrically connected to two electrodes of the battery 913.

Figure 11:
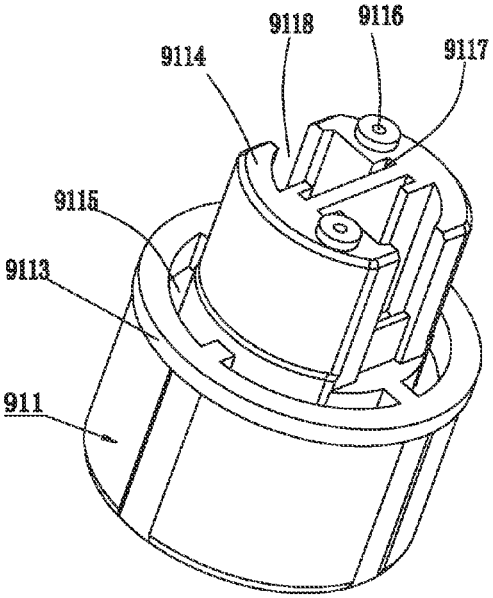
FIG. 11 is a perspective view of a female connecting element of the inhaling rod of the present invention.
Figure 12:
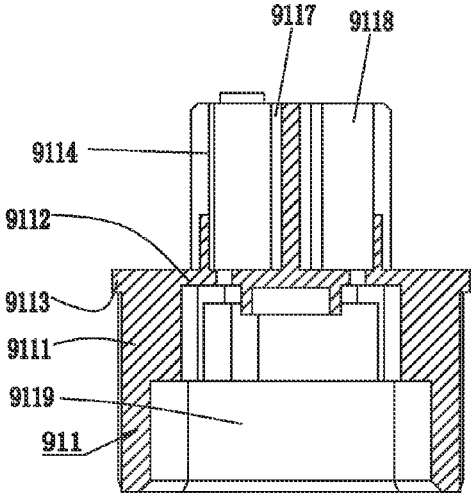
FIG. 12 is a cross-sectional view of the female connecting element of the inhaling rod of the present invention.

As shown in FIGS. 3, 11 and 12, the female connecting element 911 is configured to mate with the male connecting element 5, and is made of a flexible plastic material. The female connecting element 911 is mounted to one end of the male connecting element 5 so as to connect the inhaling rod 90 and the battery rod 91. The female connecting element 911 is substantially shaped as a round cover, and comprises a side wall 9111, an upper wall 9112, an internal chamber 9119 is defined by the side wall 9111 and the upper wall 9112, a locating step 9113 is formed on the side wall 9111 adjacent to the upper wall 9112 and extends outward radially from the female connecting element 911 for fitting to the barrel 910, and an inserting peg 9114 is disposed on the upper wall 9112 and extends outward in an axial direction of the female connecting element 911 for being inserted into the first accommodating chamber 53 of the male connecting element 5. The upper wall 9112 is concavely formed with a plurality of positioning grooves 9115 for receiving the positioning projection 56 of the male connecting element 5. Threading holes 9116 are formed in and penetrate the female connecting element 911 in the axial direction, and two electrode slits 9117 and internal channels 9118 extend in the axial direction for positioning the battery first electrode element 914 and the battery second electrode element 915. The two internal channels 9118 for the insertion of the atomizer first and second electrode elements 17 and 19 with which the battery first and second electrode elements 914 and 915 are in flexible contact in the internal channels 9118.

As shown in FIGS. 2 and 5, the bottom case 912 is mounted to the bottom end of the barrel 910 for sealing the USB connector 71. The bottom case 912 is further equipped with a sealing ring 916. It is understandable that to prevent the bottom case 912 from coming off the barrel 910 or lost after being pulled away, the bottom case 912 is further coupled with a coupling strap to connect the barrel 910. The coupling strap is capable of being disposed in the barrel 910 or integrally formed with a connecting portion or other connecting structure in order to mount the bottom case 912 onto the barrel.

Figure 14:
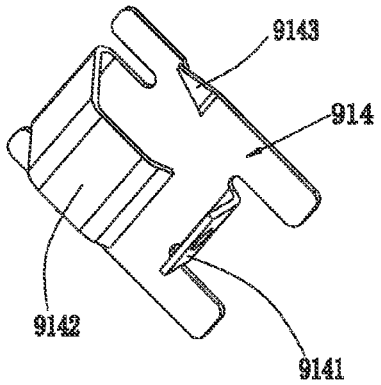
FIG. 14 is a perspective view of a battery first electrode element of the battery rod of the present invention.
Figure 15:
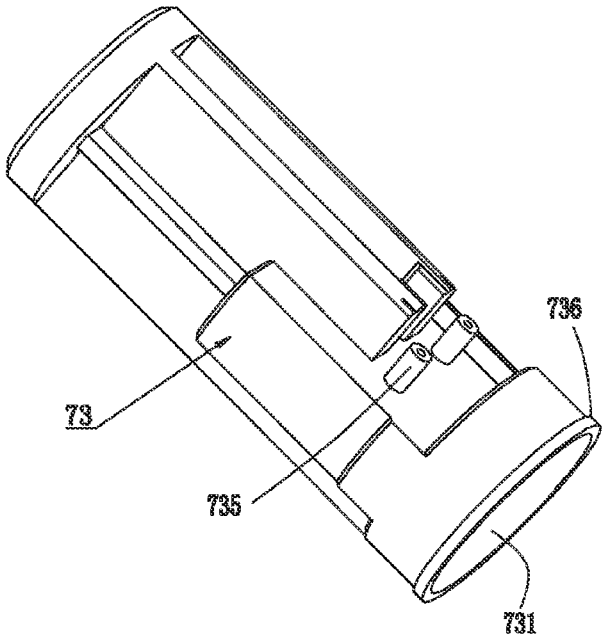
FIG. 15 is a first perspective view of a support base of the battery rod of the present invention.
Figure 16:
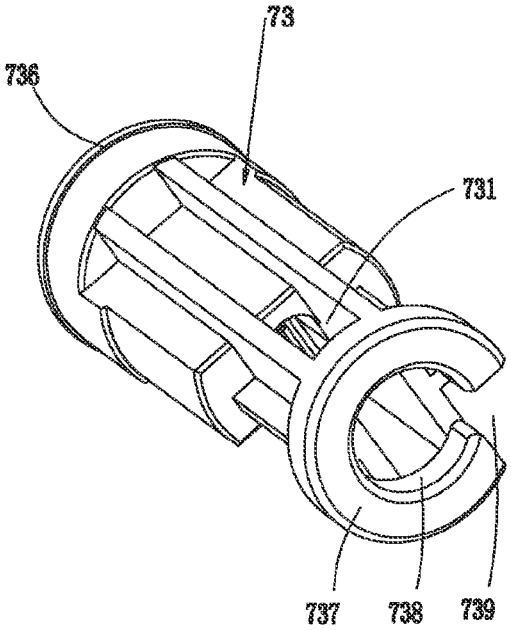
FIG. 16 is a second perspective view of the support base of the battery rod of the present invention.
Figure 17:
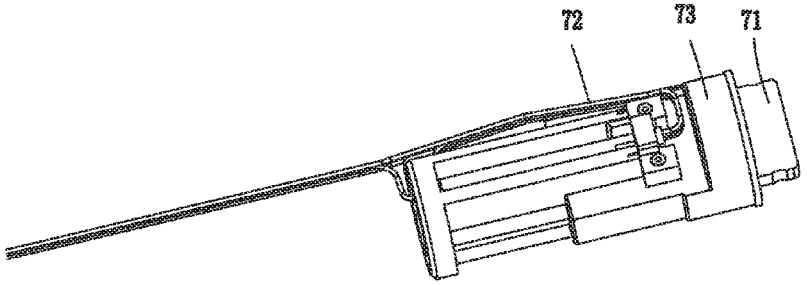
FIG. 17 is a schematic view showing a state that a Connecting device is mounted in the support base according to the present invention.

As shown in FIGS. 3, 4 and 14, the battery first and second electrode elements 914 and 915 are respectively positioned in the electrode slits 9117. The battery first electrode element 914 is a flexibly deformable metal sheet, and has a soldering plate 9141 of a soldering hole at one end of the battery first electrode element 914, a flexible contact plate 9142 being flexibly deformable and formed at another end thereof, and an engaging plate 9143 being flexibly deformable and formed at a middle thereof for engaging with the female connecting element 911. The battery second electrode element 915 has a structure same as that of the battery first electrode element 914. When the inhaling rod 90 and the battery rod 91 are being plugged together, the battery first and second electrode elements 914 and 915 of the female connecting element 911 are in flexibly contact with the atomizer first and second electrode elements 17 and 19 whereby realizing electrical connection. The battery first and second electrode elements 914 and 915 respectively electrically connect the positive and negative electrodes of the battery 913 through the soldering plates 9141 and soldering holes. The atomizer first and second electrode elements 17 and 19 are in flexible contact with the battery first and second electrode elements 914 and 915 through the flexible contact plates thereof to realize electrical connection. Accordingly, the electronic cigarette is capable of being assembled conveniently with a simplified craft and providing a reliable electrical connection.

As shown in FIGS. 3 and 5, in this embodiment, the atomizer switch 27 and the switch base 28 are disposed in the battery rod 91. Specifically, the atomizer switch 27 is disposed in the switch base 28, while the switch base 28 is disposed in the internal chamber 9119 of the female connecting element 911. Two electrodes of the atomizer switch 27 are electrically connected to the battery first and second electrode elements 914 and 915 through two wires (not shown). The atomizer switch 27 is a pneumatic type switch that is switchable according to pneumatic vibration for power on or off. The atomizer switch 27 and the battery 913 are electrically connected to the control circuit unit.

As shown in FIGS. 2, 5, 15 to 22, the connecting device 7 has the connecting device 71, a conductor 72, and a support base 73. In this embodiment, the connecting device 7 is disposed in the battery rod 91.

The connecting device 71 is intended to connect an external power in order to charge the battery 911. The USB connector 71 is also capable of transmitting, downloading, or storing multimedia data when the electronic cigarette is equipped with portable storage devices, MP3, MP4 or other multimedia functions. The connecting device 71 is mounted in the battery rod 91 through the support base 73.

As shown in FIGS. 15 to 22, the support base 73 is being substantially cylindrical, and defines a first accommodating chamber 731 therein configured to receive the connecting device 71 and the conductor 72. The support base 73 is further formed with two conductor positioning elements 735 for positioning the conductor 72. The two conductor positioning elements 735 are disposed on a side wall of the support base 73 and each is exemplified by a screw post having internal screw threads. A positioning stage 736 is radially formed on an outer wall of a front portion of the support base 73 for matching with a bottom of the barrel 910. A bottom board 737 is formed at a bottom of the support base 73, and defines a through hole 738 and an opening 739 therein. Furthermore, the outer wall of the support base 73 is formed with a conductor slit (not labeled).

In this embodiment, the first accommodating chamber 731 comprises a front portion 7311, a middle portion 7312, and a rear portion 7313 all connected with each other in sequence. The front portion 7311 is cylindrical for allowing the USB connector 71 and the conductor 72 to extend out of or retract to the support base 73. The middle portion 7312 is being substantially cylindrical or other shapes and extends outwards from a bottom surface of the front portion 7311 in an axial direction of the support base 73. The USB connector 71 is wedged into the middle portion 7312. The rear portion 7313 is intended to accommodate the conductor 72 when the conductor 72 is being retracted. The rear portion 7313 is formed by the bottom board 737 and two parallel clamping boards (not shown) extending in the axial direction. The rear portion 7313 is hollow cylindrical or has other shapes for the purpose of accommodating the conductor 72 and allowing the conductor 72 to freely move therein. A penetrating hole is formed between the middle portion 7312 and the rear portion 7313. An outer wall of the front portion 7311 is fitted with the inner wall of the barrel 910. The support base 73 is mounted in the barrel 910 through a snug-fit of the outer wall of the front portion 7311 and the barrel 910, and is positioned by the positioning stage 736 (referring to FIGS. 2, 21, and 22). In this embodiment, the conductor positioning elements 735 are disposed on an outer side of the middle portion 7312 of the first accommodating chamber 731 and integrated with the support base 73.

One end of the conductor 72 is connected to the USB connector 71 so as to extend an applicable distance of the USB connector 71. Another end of the conductor 72 is connected to the control circuit unit in order for charging or other functions. The conductor 72 comprises a movable conductor 721, a fixing conductor 722, and a coupling element 723 for coupling the movable conductor 721 and the fixing conductor 722. The coupling element 723 is positioned by an inner wall or outer wall of the first accommodating chamber 731 so as to retain the fixing conductor 722. One end of the movable conductor 721 is electrically connected to the fixing conductor 722 through the coupling element 723. The other end of the movable conductor 721 is electrically connected to the USB connector 71. One end of the fixing conductor 722 is electrically connected to the movable conductor 721 through the coupling element 723. Another end of the fixing conductor 722 is attached on the outer wall of the support base 73 along the conductor slit to pass through the opening 739 and then electrically connect the control circuit unit. The fixing conductor 722 is fixed in the battery rod 91 without being refracted or extended. The coupling element 723 is substantially U-shaped and forms two mounting holes at opposite sides thereof for mounting the conductor positioning elements 735. The coupling element 723 is fixedly mounted onto the conductor positioning elements 735, with screws screwed in the conductor positioning elements 735. Alternatively, the coupling element 735 is capable of having other shapes and being mounted in other ways. Therefore, the fixing conductor 722 of the conductor 72 is being positioned and retained in place so as to prevent the electrical connection of the conductor 72 and the control circuit unit from being affected by the movable conductor 721 when the moveable conductor 721 is being drawn.

Figure 18:
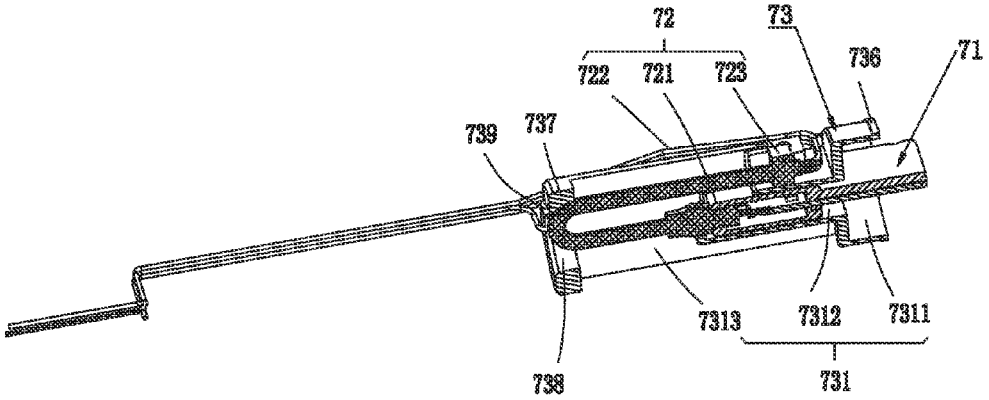
FIG. 18 is a cross-sectional view of FIG. 17.
Figure 19:
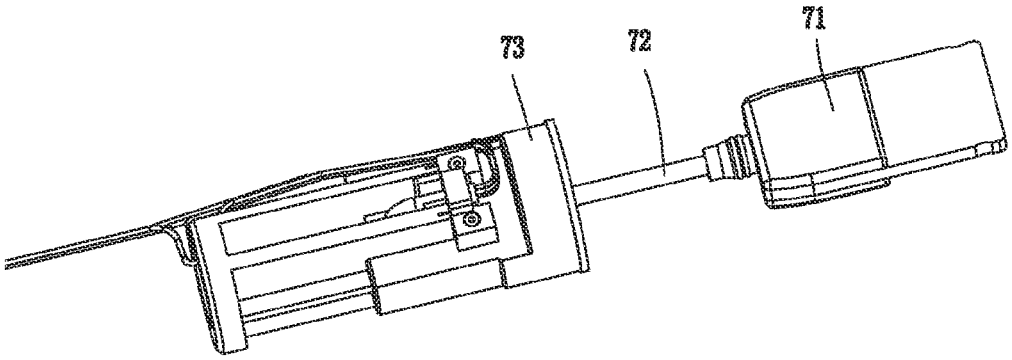
FIG. 19 is a schematic view showing a state that the connecting device is pulled out of the support base according to the present invention.
Figure 20:
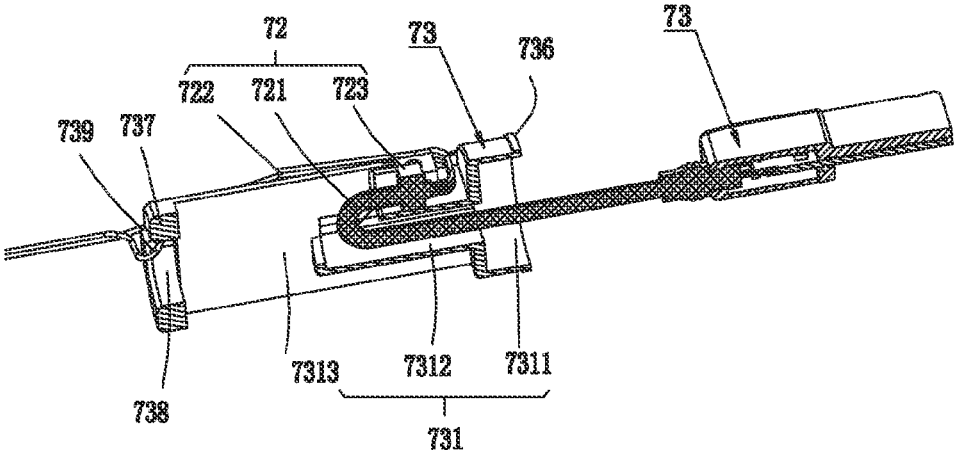
FIG. 20 is a cross-sectional view of FIG. 19.
Figure 21:
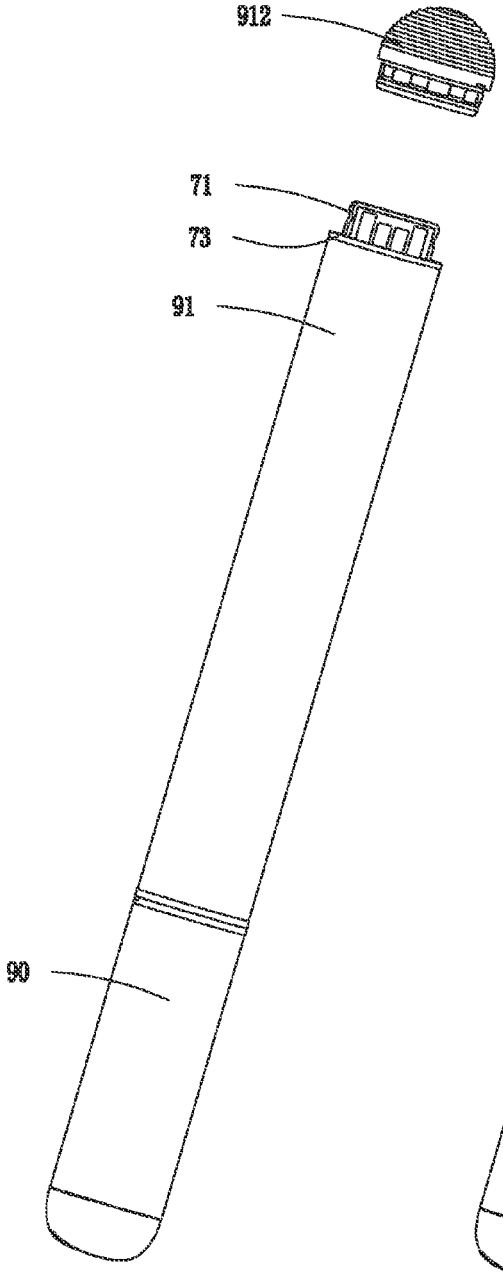
FIG. 21 is a schematic view showing a state that a bottom case is pulled out of the battery rod according to the present invention.
Figure 22:
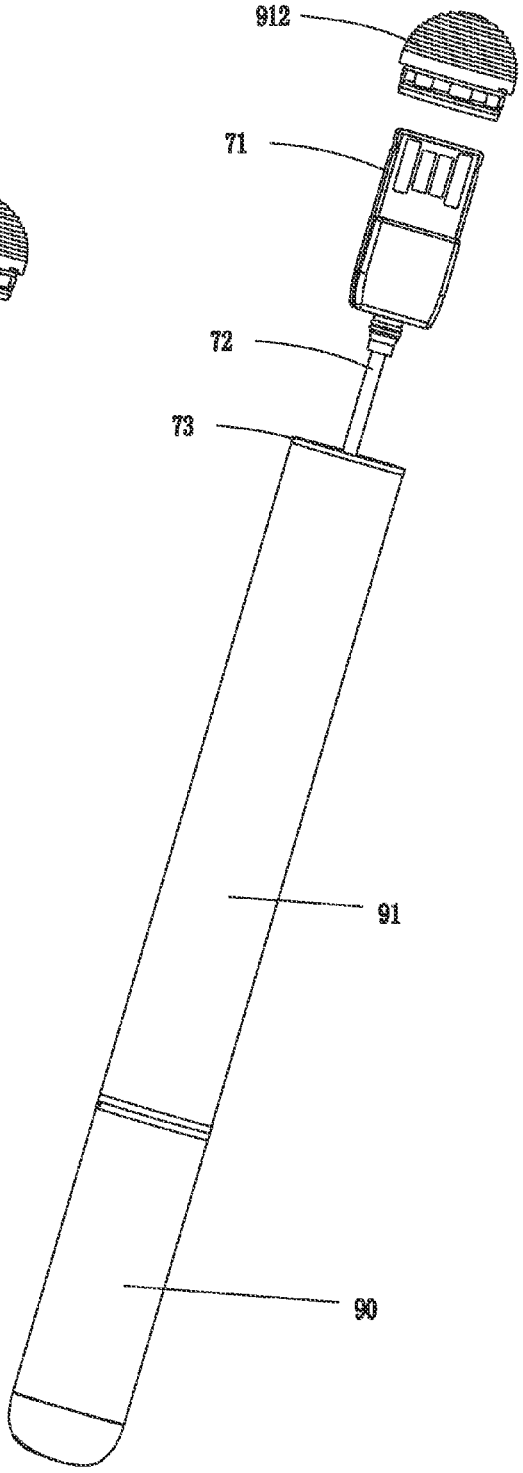
FIG. 22 is a schematic view showing a state that the connecting device is pulled out of the battery rod according to the present invention.
Figure 23:
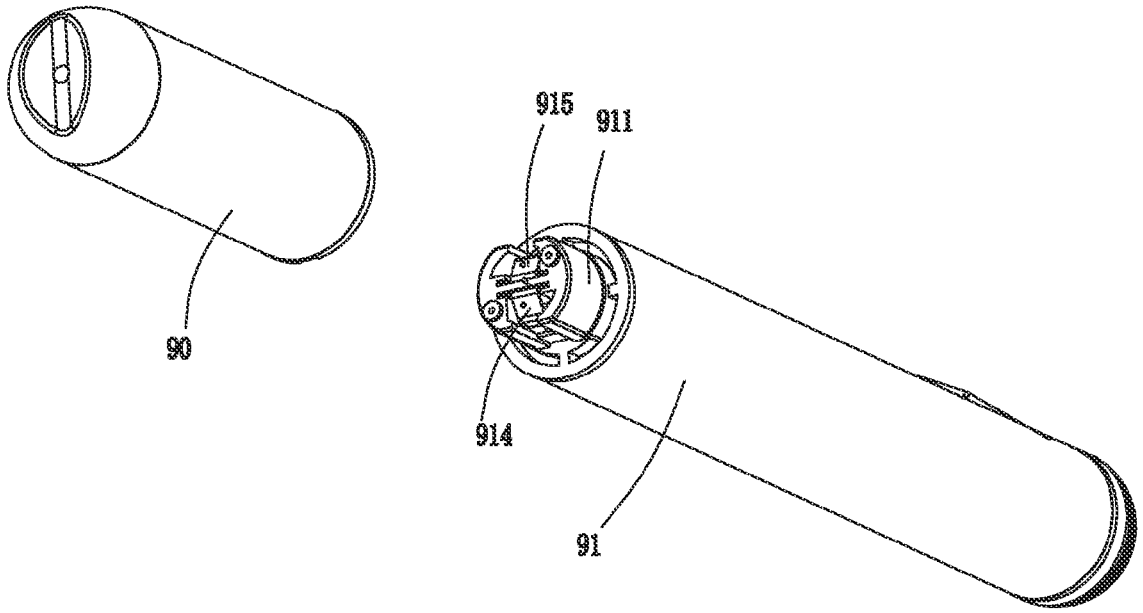
FIG. 23 is a schematic view showing a state that the inhaling rod is pulled out of the battery rod.

When the connecting device 7 is not in use, the USB connector 71 is manually depressed into the support base 73, and the bottom case 912 is being mounted, and thus the moveable conductor 721 is disposed in a conductor receiving slot 732 formed in the support base 73 (referring to FIG. 18). When the connecting device 7 is in use, first remove the bottom case 912, and then pull the USB connector 71 away of the support base 73 to come out of the barrel 910, whereby one end of the moveable conductor 721 reaches out of the barrel 910 from the first accommodating chamber 731 in conjunction with the USB connector 71 (referring to FIG. 20), and the movable conductor 721 brings the USB conductor 71 to connect with the external electronic device or power within a predetermined distance. In this embodiment, the number of the fixing conductor 722 is three, the three fixing conductors 722 respectively standing for a positive wire, a negative wire, and a signal wire for respectively connecting with respective electrodes of the control circuit unit. The connecting device 71 and the conductor 72 are disposed in the battery rod 91, and therefore such way enables a convenient usage and beautifies the electronic cigarette. The support base 73 defines the first accommodating chamber 731 for accommodating the USB connector 71 and the conductor 72 in a manner that the USB connector 71 and the conductor 72 are capable of freely moving therein.

The inhaling rod 90 and the battery rod 91 are capable of being engaged or plugged together. As an embodiment shown in FIG. 23, the inhaling rod 90 and the battery rod 91 are detachably connected with each other through the male connecting element 5 snugly plugged with the female connecting element 911 in a convenient way. Alternatively, the electronic cigarette of the present invention is a one-piece element such that the inhaling cylinder 1 of the inhaling rod 90 and the barrel 910 of the battery rod 91 are integrally formed as a one-piece case body. Also, the inhaling cylinder 1, the barrel 910, and the inhaling nozzle 4 are all integrally formed.

It is understood that the invention may be embodied in other forms within the scope of the claims. Thus the present examples and embodiments are to be considered in all respects as illustrative, and not restrictive, of the invention defined by the claims.

What is claimed is:

1. An electronic cigarette, comprising:

a cigarette body and a connecting device wherein the connecting device is retractably disposed in the cigarette body so as to be hidden therein;

the connecting device comprising a connector and a conductor of which a length is extendable, the conductor capable of being drawably received in the cigarette body, one end of the conductor connected to the connector and the other end of the conductor electrically connected to a circuit control unit disposed in the cigarette body;

the connector capable of being retractably disposed in the cigarette body and extending out of the cigarette body via the retractable conductor; wherein when the connecting device is not in use, the conductor is folded and hidden within the cigarette body together with the connector, and while the connecting device is in use, the connecting device is pulled out from the cigarette body and the conductor extends outwards, whereby the connector electrically connects the electronic cigarette with an external electronic device or power source;

the connecting device further comprises a support base disposed in the cigarette body for accommodating and positioning the connector, a first accommodating chamber is defined in the support base for accommodating the connector and the conductor, a wall body of the first accommodating chamber has a cylindrical front portion for the connector and the conductor to extend out of or retract into the support base, and the cylindrical front portion corresponds to an inner wall of the cigarette body;

the conductor comprises a movable conductor and a fixing conductor both integrally connected with each other via a coupling element disposed therebetween, the coupling element is mounted to the support base, one end portion of the fixing conductor is electrically connected to one end portion of the movable conductor through the coupling element, the conductor is electrically connected to the connector through the other end portion of the movable conductor, and the conductor is electrically connected to a control circuit unit in the electronic cigarette through the other end portion of the fixing conductor.

2. The electronic cigarette according to claim 1, wherein the support base is formed with at least one conductor positioning element for mounting the coupling element, and the coupling element forms at least one mounting hole for mounting the at least one conductor positioning element; and, the cylindrical front portion of the support base has a positioning stage radially formed on an outer wall thereof for matching with the bottom of the cigarette body, the support base is mounted into the cigarette body, and the outer wall of the cylindrical front portion of the support base is mounted through a snug fit to the inner wall of the cigarette body and is positioned by the positioning stage.

3. The electronic cigarette according to claim 1, wherein the cigarette body has an inhaling rod and a battery rod, the inhaling rod comprises an inhaling cylinder, an inhaling nozzle, an atomizer disposed in the inhaling cylinder, and a cigarette liquid storing cup for storing a cigarette liquid; and the battery rod comprises a barrel, a battery installed in the barrel, and a bottom case mounted to a bottom of the barrel, wherein the connecting device is disposed in the barrel, and the bottom case covers the bottom of the barrel so as to seal the connecting device in the end of the barrel.

4. The electronic cigarette according to claim 3, wherein a male connecting element is mounted to an end portion of the inhaling cylinder and a female connecting element is mounted to an end portion of the battery rod, wherein the female connecting element and the male connecting element are configured to mate with each other so as to connect the inhaling rod and the battery rod; and, the male connecting element has atomizer electrode elements and the female connecting elements has battery electrode elements, the atomizer electrode elements and the battery electrode elements are in flexible contact with each other to realize an electrical connection.

5. The electronic cigarette according to claim 4, wherein the atomizer comprises at least one heating element, the atomizer electrode elements include an atomizer first electrode element and an atomizer second electrode element, respectively, electrically connected with positive and negative electrodes of the at least one heating element; the battery electrode elements includes a battery first electrode element and a battery second electrode element, respectively, electrically connected with positive and negative electrodes of the battery; and, the atomizer first and second electrode elements and the battery first and second electrode elements are all made of flexible metal conductive sheets.

6. The electronic cigarette according to claim 5, the atomizer first electrode element and the atomizer second electrode element, respectively, comprise: a metal conductive sheet which is flexibly deformable, a soldering plate with a soldering hole therein provided at one end thereof, a flexible contact plate which is flexibly deformable provided at another end of the respective electrode element, and an engaging plate which is flexibly deformable provided at a middle of the respective electrode element for engaging with the male connecting element.

7. The electronic cigarette according to claim 5, wherein the battery first electrode element and the battery second electrode element, respectively, comprise: a flexibly deformable metal conductive sheet, a soldering plate with a soldering hole therein at one end thereof, a flexibly deformable contact plate provided at another end of the respective battery electrode element, and a flexibly deformable engaging plate provided at a middle of the respective battery electrode element for engaging with the female connecting element.

8. An electronic cigarette, comprising:

a cigarette body and a connecting device wherein the connecting device is retractably disposed in the cigarette body so as to be hidden therein;

the connecting device comprising a connector and a conductor of which a length is extendable, the conductor capable of being drawably received in the cigarette body, one end of the conductor connected to the connector and the other end of the conductor electrically connected to a circuit control unit disposed in the cigarette body;

the connector capable of being retractably disposed in the cigarette body and extending out of the cigarette body via the retractable conductor; wherein when the connecting device is not in use, the conductor is folded and hidden within the cigarette body together with the connector, and while the connecting device is in use, the connecting device is pulled out from the cigarette body and the conductor extends outwards, whereby the connector electrically connects the electronic cigarette with an external electronic device or power source, the connector is a universal serial bus (USB) connector, a peg-type or a pin-type connector;

the connecting device further comprises a support base disposed in the cigarette body, the support base defines a first accommodating chamber for accommodating the connector and the conductor, a wall body of the first accommodating chamber has a cylindrical front portion for the connector and the conductor to extend out of or retract into the support base, wherein the cylindrical front portion corresponds to an inner wall of the cigarette body;

the support base is substantially cylindrical and defines a through hole therein, the outer wall of the support base is formed with a conductor slit, and the conductor passes through the through hole from the first accommodating chamber along the conductor slit to electrically connect to the control circuit unit.

9. An electronic cigarette, comprising:

a cigarette body and a connecting device wherein the connecting device is retractably disposed in the cigarette body so as to be hidden therein;

the connecting device comprising a connector and a conductor of which a length is extendable, the conductor capable of being drawably received in the cigarette body, one end of the conductor connected to the connector and the other end of the conductor electrically connected to a circuit control unit disposed in the cigarette body;

the connector capable of being retractably disposed in the cigarette body and extending out of the cigarette body via the retractable conductor; wherein when the connecting device is not in use, the conductor is folded and hidden within the cigarette body together with the connector, and while the connecting device is in use, the connecting device is pulled out from the cigarette body and the conductor extends outwards, whereby the connector electrically connects the electronic cigarette with an external electronic device or power source;

the cigarette body has an inhaling rod and a battery rod, the inhaling rod comprises an inhaling cylinder, an inhaling nozzle, an atomizer disposed in the inhaling cylinder, and a cigarette liquid storing cup for storing a cigarette liquid; and the battery rod comprises a barrel, a battery installed in the barrel, and a bottom case mounted to a bottom of the barrel, wherein the connecting device is disposed in the barrel, and the bottom case covers the bottom of the barrel so as to seal the connecting device in the end of the barrel;

the cigarette liquid storing cup comprises a cup seat and a cup lid which are spaced apart from each other and are in a snug-fit engagement with the inner walls of the inhaling cylinder, a guiding tube and a liquid storing element both are disposed between the cup seat and the cup lid, the guiding tube is internally hollow with two opposite ends thereof open to the outside and the guiding tube fixedly holds the atomizer; a positioning tube is mounted onto the outer walls of the guiding tube such that the positioning tube and the guiding tube are in interference fit with each other and the positioning tube abuts against the atomizer to prevent the atomizer from moving in an axial direction of the guiding tube;

a bottom of the cup lid extends radially outward to form a flange portion, wherein the flange portion is serrated and has multiple serrations, the serrations have gaps formed therebetween for the cigarette liquid to flow into the cigarette liquid storing cup.

10. The electronic cigarette according to claim 9, wherein the cup seat has a cylindrical cup structure, a positioning pillar formed in the cup seat for positioning the guiding tube, and a round internal chamber for receiving the liquid storing element; the cup lid has a hollow and substantially cylindrical lid structure including a side wall and an upper wall which define a circular internal cavity for receiving the guiding tube; a plurality of air vents are formed on a side wall of the cup lid and communicate with the circular internal cavity; a plurality of ribs are formed on the upper wall of the cup lid in the circular internal cavity, wherein each of the plurality of ribs has a width smaller than an inner diameter of the guiding tube; the upper wall of the cup lid and the positioning pillar of the cup seat, respectively, position the opposite ends of the guiding tube, and the flange portion of the cup lid and the round internal chamber of the cup seat, respectively, fix the opposite ends of the liquid storing element.

11. An electronic cigarette, comprising:

a cigarette body and a connecting device wherein the connecting device is retractably disposed in the cigarette body so as to be hidden therein;

the connecting device comprising a connector and a conductor of which a length is extendable, the conductor capable of being drawably received in the cigarette body, one end of the conductor connected to the connector and the other end of the conductor electrically connected to a circuit control unit disposed in the cigarette body;

the connector capable of being retractably disposed in the cigarette body and extending out of the cigarette body via the retractable conductor; wherein when the connecting device is not in use, the conductor is folded and hidden within the cigarette body together with the connector, and while the connecting device is in use, the connecting device is pulled out from the cigarette body and the conductor extends outwards, whereby the connector electrically connects the electronic cigarette with an external electronic device or power source;

the cigarette body has an inhaling rod and a battery rod, the inhaling rod comprises an inhaling cylinder, an inhaling nozzle, an atomizer disposed in the inhaling cylinder, and a cigarette liquid storing cup for storing a cigarette liquid; and the battery rod comprises a barrel, a battery installed in the barrel, and a bottom case mounted to a bottom of the barrel, wherein the connecting device is disposed in the barrel, and the bottom case covers the bottom of the barrel so as to seal the connecting device in the end of the barrel;

a male connecting element is mounted to an end portion of the inhaling cylinder and a female connecting element is mounted to an end portion of the battery rod, wherein the female connecting element and the male connecting element are configured to mate with each other so as to connect the inhaling rod and the battery rod; and, the male connecting element has atomizer electrode elements and the female connecting element has battery electrode elements, the atomizer electrode elements and the battery electrode elements are in flexible contact with each other to realize an electrical connection;

the male connecting element is substantially shaped as an internally hollow, round cover and has multiple air inlets formed radially at a bottom of the male connecting element, and the bottom of the male connecting element extends radially outward to form a positioning step for abutting against a bottom of the inhaling cylinder; a first accommodating chamber is formed on the bottom of the male connecting element for snugly mounting onto the battery rod; electrode slots are formed on a middle portion of the male connecting element and penetrate the male connecting element in an axial direction thereof; and, a positioning projection is radially formed on the bottom of the male connecting element and extends outward in an axial direction.

12. The electronic cigarette according to claim 11, wherein the female connecting element is substantially shaped as a round cover comprising a side wall, an upper wall and an internal chamber; a locating step is formed on the side wall adjacent to the upper wall and extends radially outward from the female connecting element for fitting to the battery rod; an inserting peg is disposed on the upper wall and extends outward in an axial direction of the female connecting element for being inserted into the first accommodating chamber of the male connecting element; the upper wall is concavely formed with a plurality of positioning grooves for receiving the positioning projection of the male connecting element; threading holes are formed in and penetrate the female connecting element in the axial direction; and, two electrode slits extend in the axial direction of the female connecting element for positioning the battery electrode elements and two internal channels into which the atomizer electrode elements are inserted extend in the axial direction of the female connecting element, wherein the atomizer electrode elements and the battery electrode elements are in flexible contact in the internal channels.

* * * * *